US006444101B1

(12) United States Patent
Stevens et al.

(10) Patent No.: US 6,444,101 B1
(45) **Date of Patent: *Sep. 3, 2002**

(54) CONDUCTIVE BIASING MEMBER FOR METAL LAYERING

(75) Inventors: Joseph Stevens, San Jose; Norman Cowan, Fremont; Chien-Shien Tzou, Saratoga, all of CA (US)

(73) Assignee: Applied Materials, Inc., Santa Clara, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/439,294

(22) Filed: Nov. 12, 1999

(51) Int. Cl.[7] ..... C25D 17/00

(52) U.S. Cl. ..... 204/224 R; 204/297.14; 204/DIG. 7

(58) Field of Search ..... 204/224 R, 297.05, 204/297.01, 297.14, DIG. 7

(56) References Cited

U.S. PATENT DOCUMENTS

| | | | | | |
|---|---|---|---|---|---|
| 4,364,816 | A | * | 12/1982 | Birt | 204/297 W |
| 4,645,580 | A | | 2/1987 | Paulet et al. | 204/272 |
| 5,135,636 | A | | 8/1992 | Yee et al. | 205/96 |
| 5,429,733 | A | * | 7/1995 | Ishida | 204/224 R |
| 6,004,440 | A | | 12/1999 | Hanson et al. | 204/279 |
| 6,071,388 | A | * | 6/2000 | Uzoh | 204/297 R |
| 6,080,291 | A | * | 6/2000 | Woodruff et al. | 204/297.01 |
| 6,139,703 | A | | 10/2000 | Hanson et al. | 204/212 |
| 6,156,167 | A | | 12/2000 | Patton et al. | 204/270 |
| 6,343,793 | B1 | | 2/2002 | Patton et al. | 277/361 |

* cited by examiner

*Primary Examiner*—Bruce F. Bell
*Assistant Examiner*—Wesley A. Nicolas
(74) *Attorney, Agent, or Firm*—Moser, Patterson & Sheridan

(57) ABSTRACT

A contact ring applies electroplating to a substrate having an electrically conductive portion. The contact ring comprises an annular insulative body, a conductive biasing member, and a seal member. The annular insulative body defines a central opening. The conductive biasing member is configured to exert a biasing force upon the substrate.

47 Claims, 6 Drawing Sheets

CONDUCTIVE BIASING MEMBER FOR METAL LAYERING

BACKGROUND OF THE INVENTION

1. Field of the Invention

The present invention generally relates to deposition of a metal layer. More particularly, the present invention relates to electrical contacts used for layering a metal onto a substrate.

2. Description of the Prior Art

Sub-quarter micron, multi-level metallization is an important technology for the next generation of ultra large scale integration (ULSI). The multilevel interconnects used in this technology require planarization of interconnect features formed in high aspect ratio apertures, including contacts, vias, lines and other features. Reliable formation of these interconnect features improves acceptance of ULSI, permits increased circuit density, and improves quality of individual substrates and die.

As circuit densities increase, the widths of vias, contacts and other features, as well as the width of the dielectric materials between the features, decrease considerably; however, the height of the dielectric layers remains substantially constant. Therefore, the aspect ratios for the features (i.e., their height or depth divided by width) increases. Many traditional deposition processes, such as physical vapor deposition (PVD) and chemical vapor deposition (CVD), presently have difficulty providing features having aspect ratios greater than 4:1, and particularly greater than 10:1. Therefore, great amount of ongoing effort is directed at the formation of void-free, nanometer-sized features having high aspect ratios of 4:1, or higher. Additionally, as feature widths decrease, the feature current remains constant or increases, resulting in increased feature current density. Such an increase in current density can damage components on the substrate.

Elemental aluminum (Al) and its alloys are the primary metals used to form lines, interconnects, and plugs in semiconductor processing. The use of aluminum results from its perceived low electrical resistivity, its superior adhesion to silicon dioxide ($SiO_2$), its ease of patterning, and the ease of obtaining it in a highly pure form. However, aluminum actually has a higher electrical resistivity than other more conductive metals such as copper. Aluminum can also suffer from electromigration leading to the formation of voids in the conductor.

Copper and its alloys have a lower electrical resistivity and a significantly higher electromigration resistance than aluminum. These characteristics are important for supporting the higher current densities, resulting from higher levels of integration and increased device speed, associated with modern devices. Copper also has good thermal conductivity and is available in a highly pure state. Therefore, copper is becoming a,preferred metal for filling sub-quarter micron, high aspect ratio interconnect features on semiconductor substrates.

Despite the desirability of using copper for semiconductor device fabrication, choices of fabrication methods for depositing copper into very high aspect ratio features, e.g. 4:1 or above, are limited. CVD deposition of copper has not developed and produces unsatisfactory results because of voids formed in the metallized copper.

Electroplating, previously limited in integrated circuit design to the fabrication of lines on circuit boards, now is used to fill semiconductor device vias and contacts. Metal electroplating, in general, is known and can be achieved by a variety of techniques. A typical electroplating technique comprises initially depositing a barrier layer over the feature surfaces of the substrate; depositing a conductive metal seed layer, over the barrier layer and then electroplating a conductive metal, preferably copper, over the seed layer to fill the structure/feature. Finally, the deposited layers and the dielectric layers are planarized by, e.g., chemical mechanical polishing (CMP), to define a conductive interconnect feature.

Electroplating is achieved by delivering electric power to the seed layer and then exposing the substrate plating surface to an electrolytic solution containing the metal to be deposited. The seed layer provides good adhesion for the subsequently deposited metal layer, as well as a conformal layer for uniform growth of the metal layer thereover. A number of obstacles impairs consistently reliable electroplating of copper onto substrates having nanometer-sized, high aspect ratio features. These obstacles include providing uniform power distribution and current density across the substrate plating surface to form a metal layer having uniform thickness.

One current method for providing power to the plating surface uses contact pins to electrically couple the substrate seed layer to a power supply. Present designs of cells for electroplating a metal on a substrate are based on a fountain plater (as shown in FIG. 1 as 10), including contact pins 56. The fountain plater 10 includes an electrolyte container 12 having top opening 13, removable substrate holder 14 that may be placed into the top opening 13, an anode 16 disposed at a bottom portion of the electrolyte container 12, and contact ring 20 configured to contact the substrate 48 and hold the substrate in position. The contact ring 20, shown in detail in FIG. 2, comprises a plurality of the contact pins 56 that extend radially relative to the contact ring 20, and are distributed about the contact ring 20. Typically, contact pins 56 include conductive material such as tantalum (Ta), titanium (Ti), platinum (Pt), gold (Au), copper (Cu), Titanium Nitride (TiN), or silver (Ag). Outer contact region 55 of each contact pin 56 extends over an outer peripheral edge 53 of the contact ring 20. The plurality of contact pins 56 extend radially inwardly over an inner peripheral edge 59 of the substrate 48 and contact a conductive seed layer of the substrate 48 at the tips of the contact pins 56. Inner contact region 57 of contact pins 56 contacts the seed layer (not shown, but included on substrate 48) at the extreme edge of the substrate 48 to provide an electrical connection to the seed layer. The inner contact regions 57 are configured to minimize the electrical field and mechanical binding effects of the pins 56 on substrate 48.

Substrate 48 is secured within and located on top of the electrolyte container 12 that is cylindrical to conform to the shape of the substrate, and electrolyte flow impinges perpendicularly on a substrate plating surface 54 of substrate 48 during operation of the fountain plater 10.

The substrate 48 functions as a cathode, and may be considered as a work-piece being controllably electroplated. Contact ring 20, shown in FIG. 2, provides cathode electrical bias to the substrate plating surface 54 resulting in the electroplating process. Typically, the contact ring 20 comprises a metallic or semi-metallic conductor. Because the contact ring is exposed to the electrolyte, conductive portions of the contact ring 20, such as contact pins 56, accumulate plating deposits. Deposits on the contact pins 56 change the physical electrical and chemical characteristics of the conductor and eventually deteriorate the electrical performance of the contact ring 20, resulting in plating defects due to non-uniform current distribution to the substrate. Efforts to minimize unwanted plating of substrate 48 include covering contact ring 20 and the outer surface of contact pins 56 with a non-plating or insulation coating.

However, while insulation coating materials may prevent plating on exposed surfaces of the contact pin 56, the upper contact surface remains exposed. Thus, after extended use of the fountain plater of FIG. 1, solid deposits inevitably form on the contact pins 56. Because of varied deposits upon different contact pins 56, each contact pin has unique geometric profiles and densities, thus producing varying and unpredictable contact resistance between contact pins 56 at the interface of the contact pins and seed layer. This varying resistance of the contact pins results in a non-uniform current density distribution across the substrate because of the resultant modified electrical fields. Also, the contact resistance at the pin/seed layer interface may vary from substrate to substrate, resulting in inconsistent plating distribution between different substrates using the same equipment. Furthermore, the plating rate is maximized near the region of the contact pins, and is decreased at further distances therefrom. A fringing effect of the electrical field also occurs at the edge of the substrate due to the localized electrical field emitted by the contact pins, causing a higher deposition rate near the edge of the substrate where the pin contact occurs.

Unwanted deposits are also a source of contamination and create potential for damage to the substrate. These deposits bond the substrate 48 to the contact pins 56 during processing. Subsequently, when the substrates are removed from the fountain plater 10, the bond between the contact pins 56 and the substrate 48 must be broken, leading to particulate contamination. Additionally, breaking the bond between the contact pins 56 and the substrate 48 requires force which may damage the substrate.

The fountain plater 10 in FIG. 1 also suffers from the problem of backside deposition applied to substrate 48. Contact pins 56 shield only a small portion of the substrate surface area, some electrolyte solution passes to the backside of the substrate (passing between the substrate 48 and the contact ring 20), thus forming a deposit on the backside and the substrate holder 14. Backside deposition may lead to undesirable results such as diffusion into the substrate during subsequent processing, as well as subsequent contamination of system components.

U.S. Pat. No. 5,690,795, issued Nov. 15, 1997 to Rosenstein et al., and assigned to the owner of the present invention (incorporated herein by reference) discloses a spring arrangement used to retain a shield in position without using screws. The springs are configured to permit electric current pass therethough while the springs are retaining the shield in position. In this prior art system, the spring is positioned remotely from, and does not interact electrically with, the substrate.

Therefore, there remains a need for an apparatus that delivers a uniform electrical power distribution to a substrate surface in an electroplating cell to deposit reliable and consistent conductive layers on substrates. It would be preferable to minimize plating on the apparatus and on the backside of the substrate, and also to minimize unpredictable plating of conductor pins.

SUMMARY OF THE INVENTION

The present invention relates to a contact ring used to apply electroplating to a substrate having an electrically conductive portion. The contact ring includes an annular insulative body, a conductive biasing member, and a seal member. The annular insulative body defines a central opening. In one embodiment of the invention, the conductive biasing member is configured to exert a biasing force upon the substrate. The conductive biasing member applies electricity to the electrically conductive portion when the electrically conductive portion is placed in contact with the conductive biasing member.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures.

DETAILED DESCRIPTION OF THE PREFERRED EMBODIMENT

Structural

Figure 8:
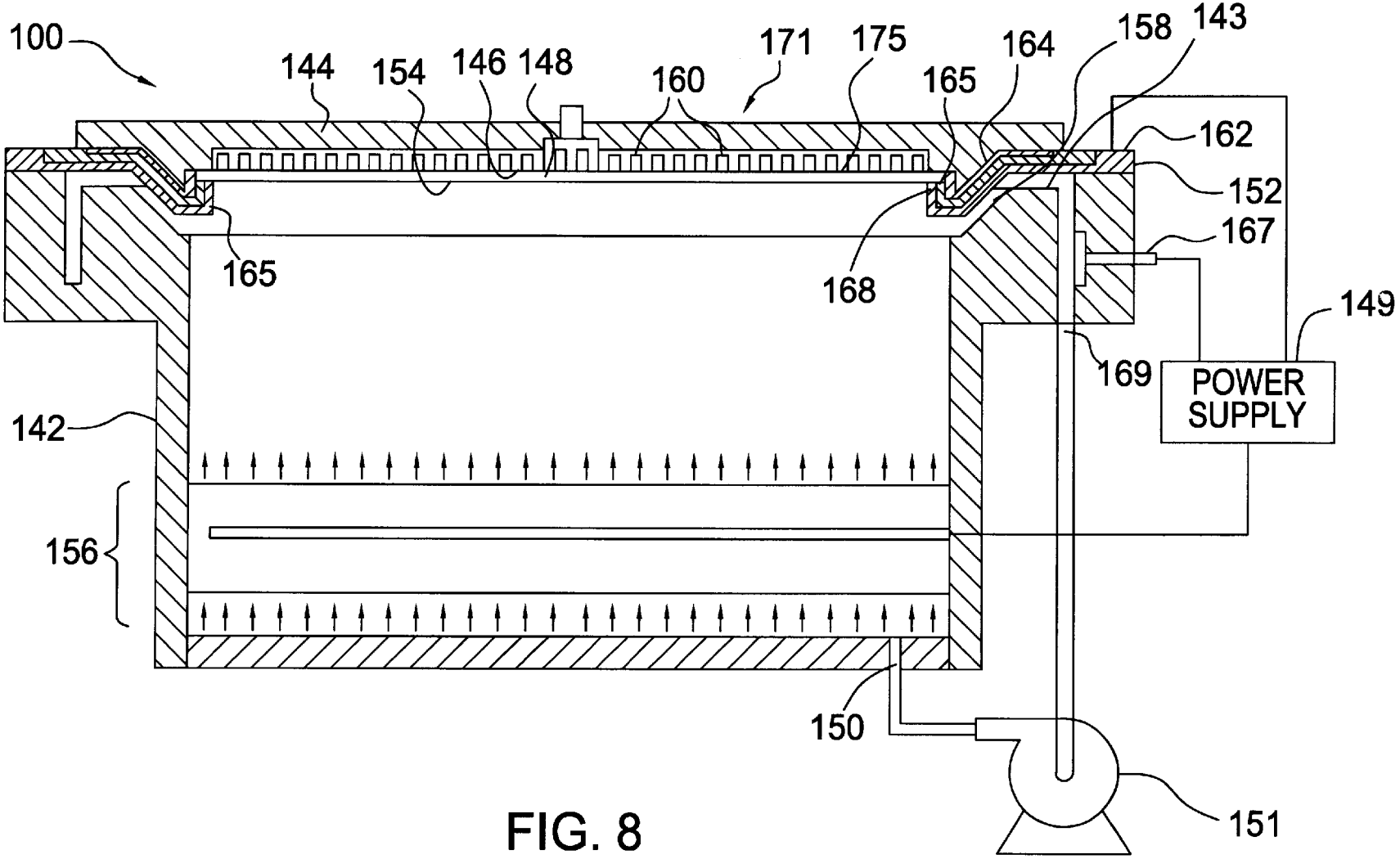
FIG. 8 is a partial cut-away perspective view of an electro-chemical deposition cell of one embodiment of the present invention, showing the interior components of the electro-chemical deposition cell.

FIG. 8 is a partial vertical cross sectional schematic view of one embodiment of an electroplating cell 100 for electroplating a metal onto a substrate incorporating many of the above-described aspects of the present invention. The electroplating cell 100 generally comprises an electrolyte container body 142 having an opening 191 formed on a top portion thereof. The container body 142 is preferably made of an electrically insulative material such as plastic. The container body is configured to receive and support a lid 144. The lid 144 serves as a top cover having a substrate supporting surface 146 disposed on the lower portion thereof. A substrate 148 is shown in parallel abutment to the substrate supporting surface 146. The electrolyte container body 142 is preferably sized and cylindrically shaped to accommodate the generally cylindrical substrate 148. However, the container body 142 can be formed in other shapes as well. An electrolyte solution inlet 150 is disposed at the bottom portion of the electrolyte container body 142. The electrolyte solution is pumped into the electrolyte container body 142 by a suitable pump 151 connected to the inlet 150; and the electrolyte solution flows upwardly inside the electrolyte container body 142 toward the substrate 148 to contact the exposed substrate plating surface 154. A consumable anode 156 is disposed in the electrolyte container body 142 to provide a metal source in the electrolyte.

The electrolyte container body 142 includes an egress gap 158 bounded at an upper limit by the shoulder 164 of the contact ring 152 and leading to an annular weir 143 substantially coplanar with (or slightly above) the substrate seating surface 168 and thus the substrate plating surface 154. The annular weir 143 is configured to ensure that the upper level of the electrolyte solution is above the substrate plating surface 154 when the electrolyte solution flows into the annular weir 143. In an alternate embodiment, the upper surface of the weir 143 is slightly below the substrate plating surface 154 such that when the electrolyte overflows the annular weir 143, the electrolyte contacts the substrate plating surface 154 through meniscus properties (i.e., capillary force).

The substrate seating surface 168 preferably extends a minimal radial distance inward below a perimeter edge of the substrate 148, but a distance sufficient to establish electrical contact with a metal seed layer on the substrate deposition surface 154. The exact inward radial extension of the substrate seating surface 168 may be varied according to the application. However, in general this distance is minimized so that a maximum deposition surface 154 surface is exposed to the electrolyte. In a preferred embodiment, the radial width of the seating surface 168 is placed close to the edge.

Figure 3:
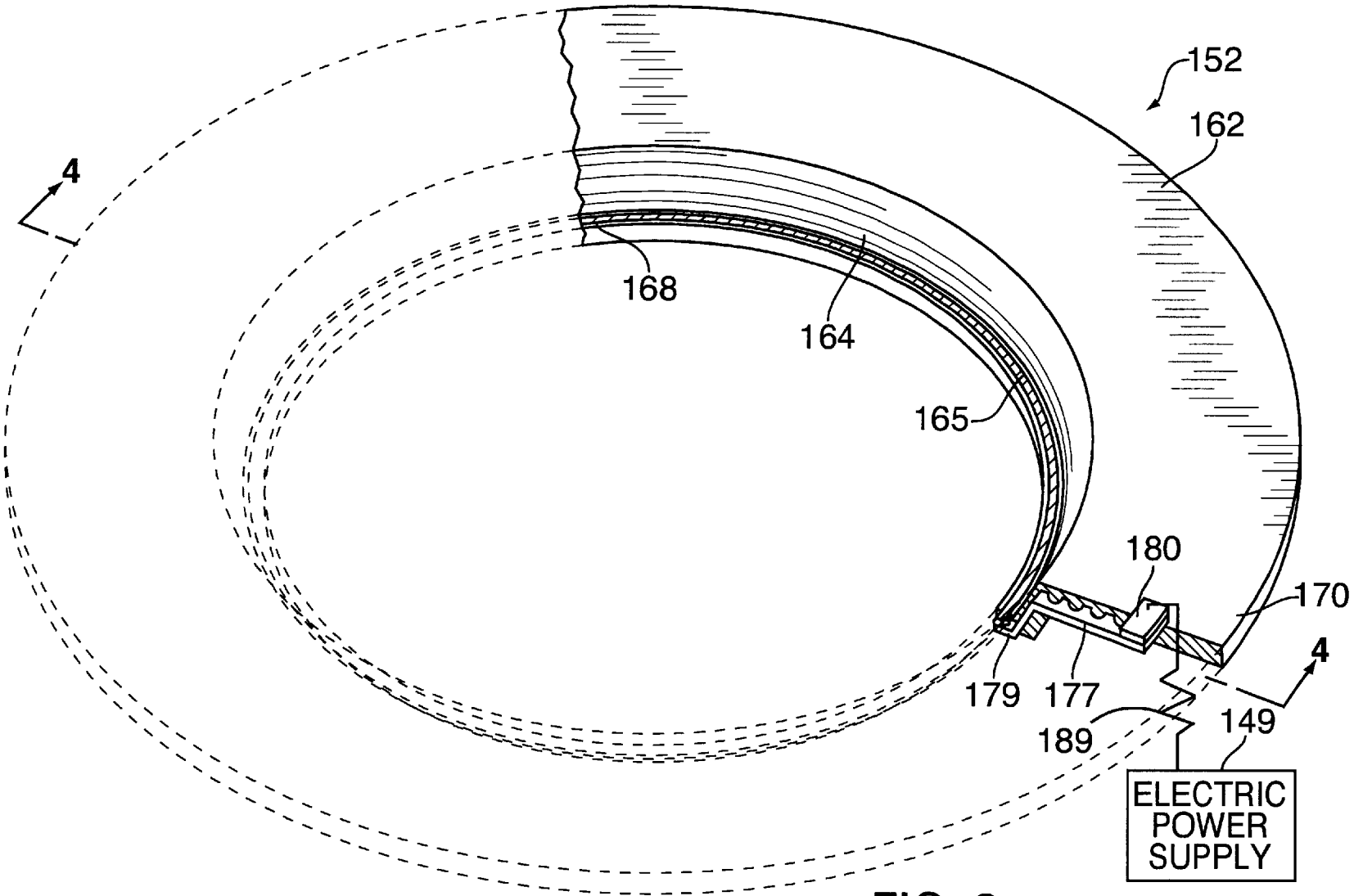
FIG. 3 is a partial cross sectional perspective view of a cathode contact ring including one embodiment of conductive biasing member/seal portion of the present invention.
Figure 4:
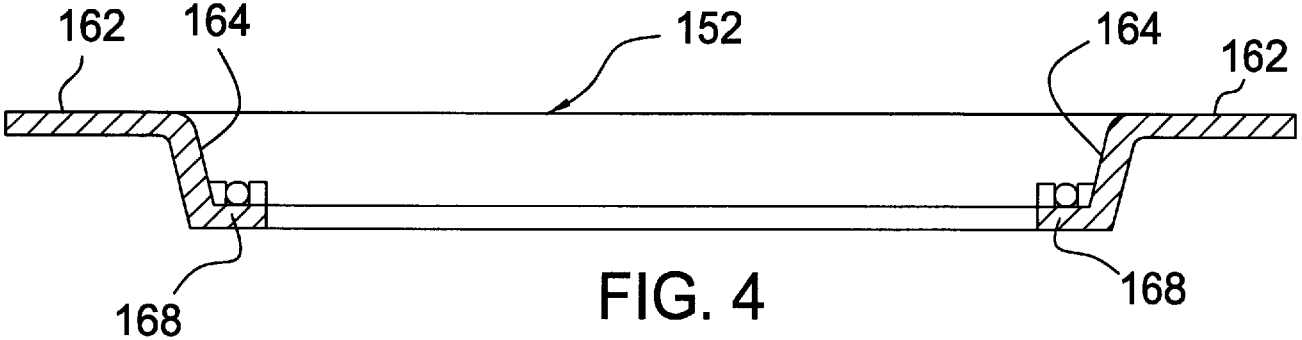
FIG. 4 is a cross sectional view of the FIG. 3 cathode contact ring as taken along sectional lines 4—4 of FIG. 3.
Figure 5:
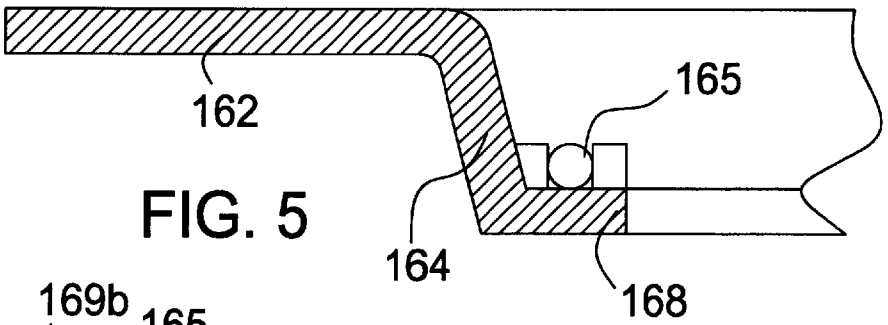
FIG. 5 is an expanded cross sectional view of the left side of the cathode contact ring of FIG. 4.
Figure 11:
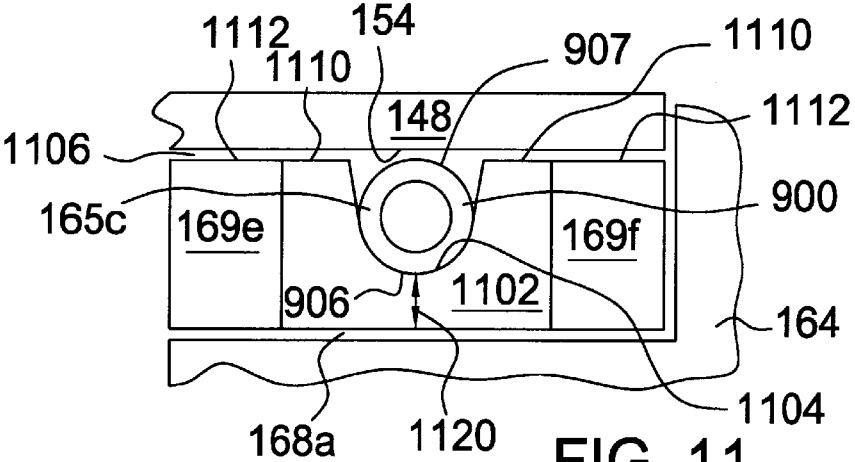
FIG. 11 is an alternate embodiment of conductive biasing member/seal portion of another embodiment of the present invention.
Figure 7:
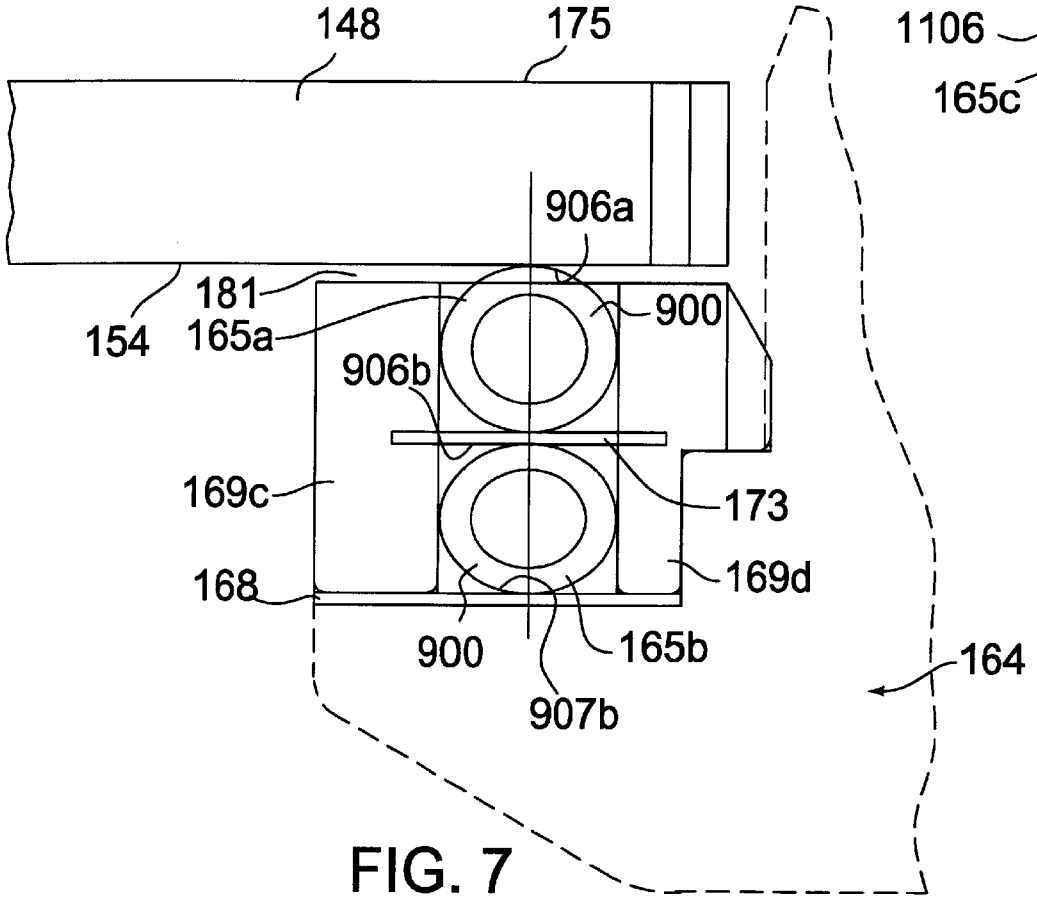
FIG. 7 is a an alternate embodiment of the conductive biasing member/seal portion of the present invention.

There are three embodiments of conductive biasing member 165 of the present invention that will now be described in order. The first embodiment of the present invention is depicted in FIG. 3. The second embodiment of the present invention is depicted in FIG. 7. The third embodiment of the present invention is depicted in FIG. 11.

Figure 1:
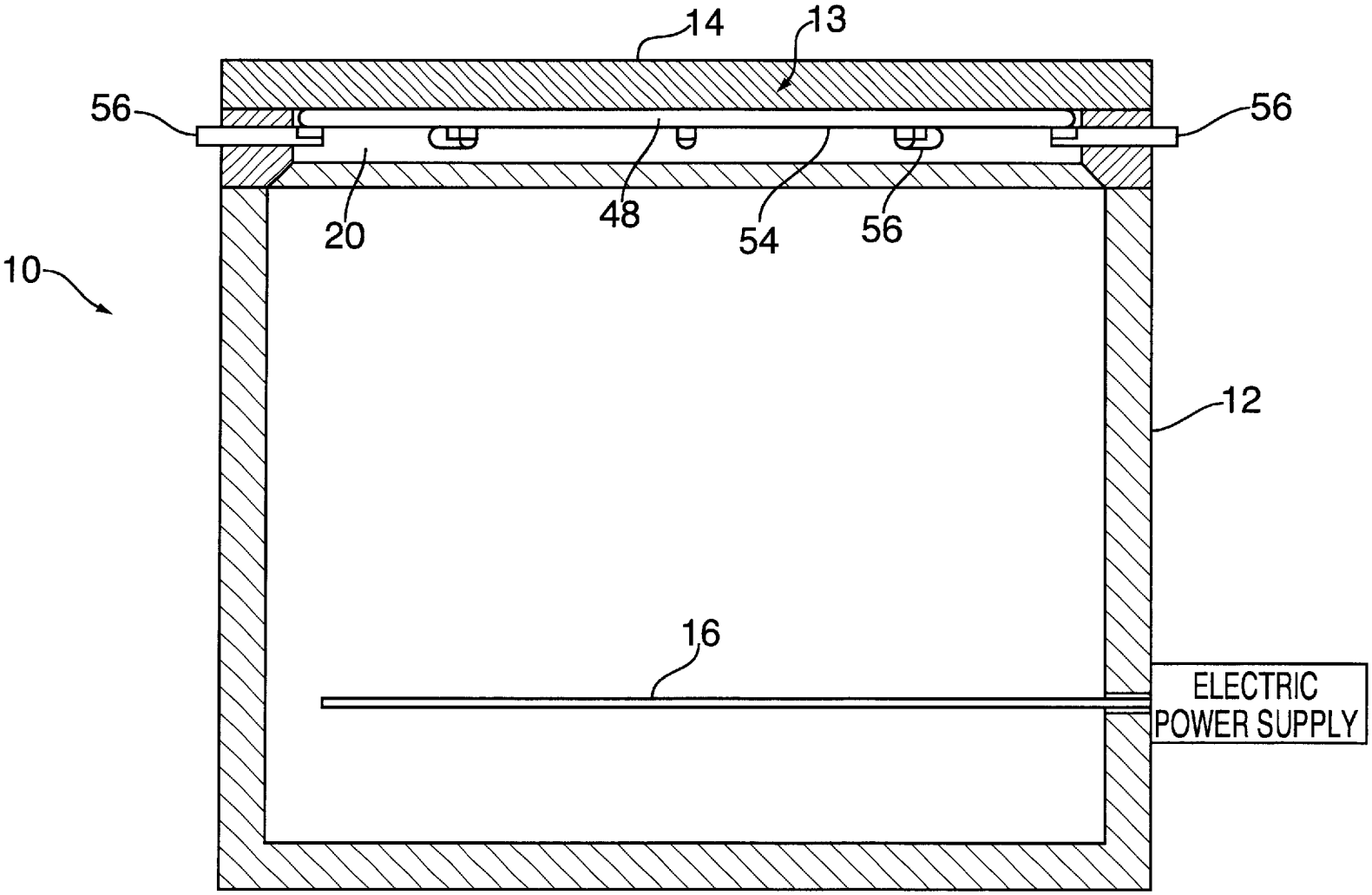
FIG. 1 (PRIOR ART)
FIG. 1 is a cross sectional view of a prior art fountain plater.
Figure 2:
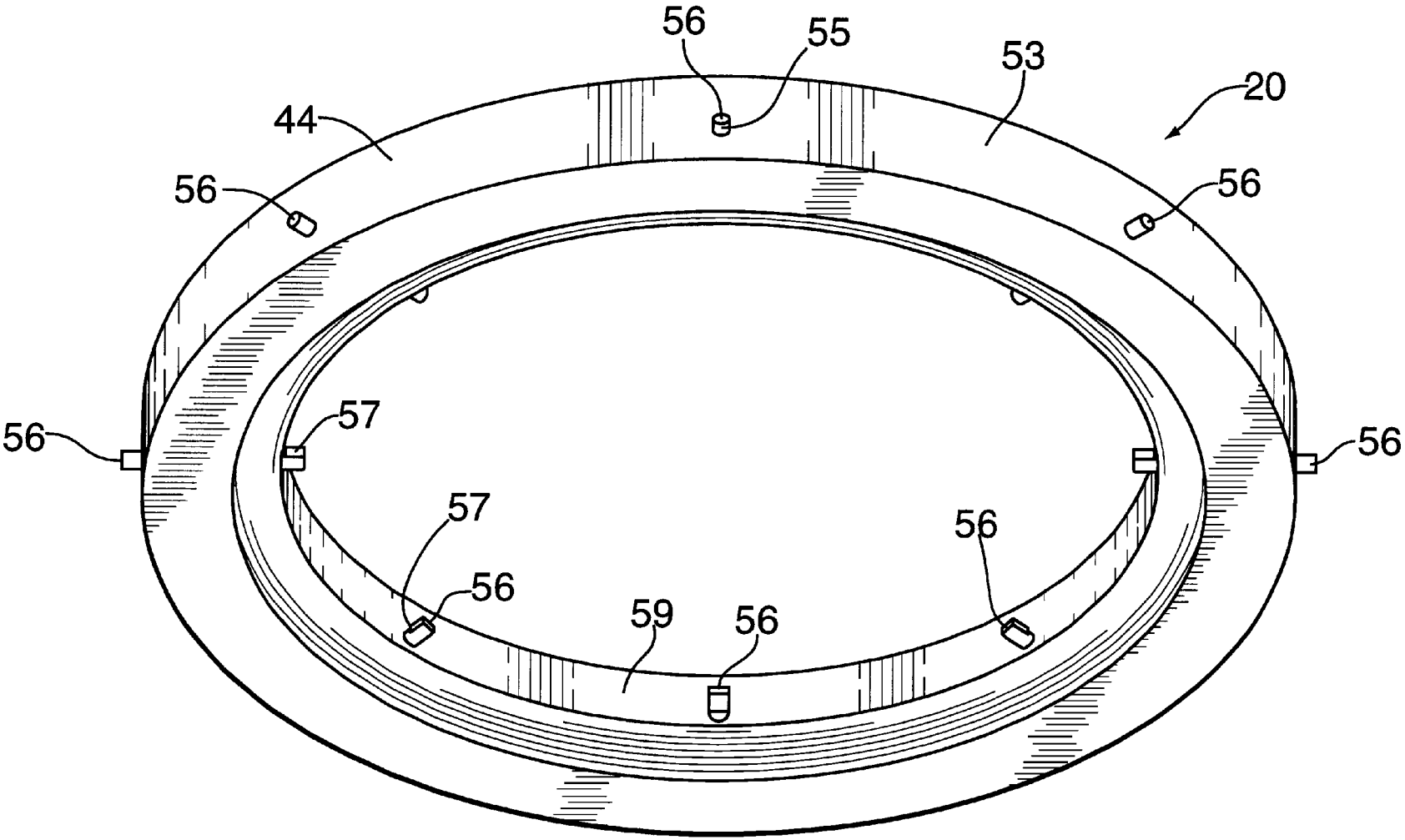
FIG. 2 (PRIOR ART)
FIG. 2 is a perspective view of a prior art cathode contact ring including a plurality of contact pins.

FIG. 3 is a cross sectional view of a cathode contact ring 152 of one embodiment of the present invention. In general, the contact ring 152 comprises an annular insulative body 170 having at least one circumferentially extending conductor element 177 disposed thereon. The annular insulative body is constructed of an insulating material to electrically isolate the conductor element 177. Together, the annular insulative body 170 and conductor element 177 support, and provide a current to, the substrate 48 shown in FIG. 1. The contact ring 152 is configured to limit passage of material between itself and a substrate as described below.

Annular insulative body 170 has a flange 162, a downward sloping shoulder portion 164, and a substrate seating surface 168. The flange 162 and the substrate seating surface 168 are substantially parallel and offset to each other, and are connected by the shoulder portion 164. Contact ring 152 in FIG. 3 is intended to be merely illustrative. In another embodiment, the shoulder portion 164 is of a steeper angle (including substantially vertical so as to be substantially normal to both flange 162 and substrate seating surface 168). Alternatively, contact ring 152 may be substantially planar, thus effectively eliminating shoulder portion 164.

The conductive biasing member 165 extends adjacent to the substrate seating surface 168 (preferably the former contacts and is supported by the latter). A single conductive biasing member 165 extends around the entire periphery of the substrate seating surface 168. In an alternate embodiment, not shown, the singular conductive biasing member 165 is replaced by a plurality of conductive biasing members, each of which extends about an annular portion (e.g., one quarter) of the substrate seating surface 168. Conductor element 177 connects electrical power supply 149 to conductive biasing member 165. Conductor element 177 includes contact plate 180, which connects to electric power supply; and contact probe 179, which is electrically connected to conductive biasing member 165. Though one continuous conductor element 177 is shown in FIG. 3, more than one conductive biasing member segments may be used. If there are a plurality of conductor biasing element segments, a distinct conductor element 177 is necessary to supply electricity to each conductive biasing element from electric power supply 149. Insulative body 170 encases portions of the conductor element 177. The insulative body 170 may be formed from such materials as polyvinylidene-fluoride (PVDF), perfluoroalkoxy resin (PFA), Teflon™, Tefzel™, alumina ($Al_2O_3$) or certain ceramics.

Figure 9:
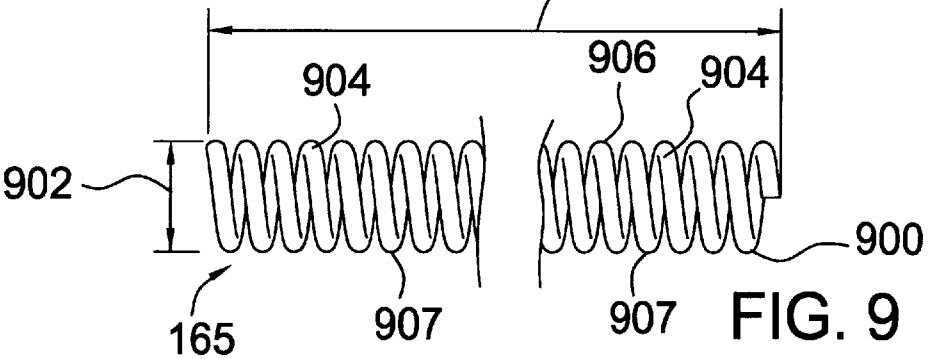
FIG. 9 is a perspective view of a canted spring used as a conductive biasing member of one embodiment of the present invention.

One embodiment of conductive biasing member 165 including a canted spring 900 is depicted in FIG. 9. This embodiment of conductive biasing member is used in the embodiments shown in FIGS. 3, 7, and 11, as described below. The canted spring 900 is selected to deform along its height 902 by a desired amount when vertically compressed by a force exerted from above, with the canted spring oriented as depicted in FIG. 9. Such compression results, for example, when substrate 148 is positioned above the substrate seating surface 168, as shown in FIG. 7. As canted spring 900 is vertically compressed, each coil 904 tends to "flatten", resulting in upper contact point 906 at each coil moving to the left relative to base 907 of that coil (the orientation as depicted in FIG. 9). This movement of the contact point 906 provides relative motion between each contact point 906 of each coil and the substrate 148, which tends to scratch off deposits, metal oxides, and other impurities formed on either the conductive biasing member 165 or substrate 148, thereby improving the electrical contact therebetween.

While the conductive biasing member 165 is shown in FIG. 3 as the only element adjacent to the substrate seating surface, there are a variety of configurations that can be applied to the substrate seating surface that are within the scope of the present invention. Though the conductive biasing member 165 is depicted in FIG. 3 as a canted spring (a portion of the canted spring is shown expanded in FIG. 9), any flexible, conductive element (possibly rectangular, or of some other said geometry) could be used as a conductive biasing member 165 and is within the scope of the present invention. An advantage of using a canted spring as the conductive biasing member 165 is that displacement of the contact points 906 during flattening of the canted spring may enhance electrical contact, as described above.

The FIG. 7 embodiment shows an alternate embodiment conductive biasing member/seal of the present invention that includes a plurality of canted springs 165*c*, 165*d* positioned between, in piggy-back fashion, seals 169*c* and 169*d*. The conductive biasing members 165*a*, 165*b* are similar to the conductive biasing member 165 shown in the FIG. 3 embodiment. A conductive positioning element 173 is affixed to, and extends between, seals 169*a* and 169*b*. Upper conductive biasing member 165*a* is positioned between the two seals 169*c*, 169*d* and above the conductive positioning element 173; while lower conductive biasing member 165*b* is positioned between the two seals 169*c*, 169*d* and below the conductive positioning element 173.

The conductive positioning element 173 in FIG. 7 is configured to ensure that this embodiment provides an increased resilience since any vertical spring deflection is absorbed by the two conductive biasing members 165*a* and 165*b* instead of the one conductive biasing member 165 in the FIG. 3 embodiment. Therefor, each conductive biasing member in the FIG. 7 embodiment is required to undergo only half of the total spring deflection caused by the relative deflections between substrate 148 and the substrate seating surface 168. Thus, the since larger spring defections might be sufficient to damage, or permanently deform, a single spring, dividing the necessary spring deflection by half may increase spring longevity as compared with the FIG. 6 embodiment.

Since the conductive positioning element 173 is in direct electrical contact with both of the conductive biasing members 165*a*, 165*b*, electricity supplied to either of the conductive biasing members 165*a*, 165*b* find a very good electrical connection to the plating surface 154, e.g. seed layer, of the substrate 148. Each of the conductive biasing members 165*a*, 165*b* is fashioned as a canted spring 900 shown in FIG. 9. Horizontal compression of the conductive biasing members 165*a*, 165*b* results in sliding motion of contact points 906*b*, 907*a* relative to the conductive positioning element 173 as shown in FIG. 7. Also, the horizontal compression of conductive biasing member 165*a* causes contact point 906*a* to slide relative to plating surface 154 of the substrate 148. The resultant scraping of surfaces caused by this relative sliding motion enhances the electrical connection between the conductive biasing members 165*a*, 165*b* and the conductive positioning element 173.

The FIG. 7 conductive biasing members 165*a*, 165*b* and seals 169*c*, 169*d* elements are configured to stay in position adjacent to substrate seating surface 168 even without the adhesive layer 171. The adhesive layer 171, however, more securely positions the seals and conductive biasing members in position. The adhesive layer may be fashioned any suitable replaceable adhesive layer or substance such that the adhesive layer may be easily breached as desired, and the seals and conductive biasing members may be replaced or repaired, when necessary. All seals 169*c*, 169*d* and conductive biasing members 165*a*, 165*b* may be removed, upwardly as a unit, the direction taken as depicted in FIG. 7. This configuration permits easy maintenance and replacement of these parts.

FIG. 11 shows yet another embodiment of conductive biasing member 165*c* used with seals 169*e*, 169*f*. The conductive biasing member 165*c* is similar to the conductive biasing member 165 shown in the FIG. 3 embodiment. FIG. 11 additionally includes conductive resilient positioning member 1102 that is generally U-shaped, including recess 1104. The recess 1104 is configured to receive conductive biasing member 165*c* therein. In FIG. 11, the conductive biasing member 165 is preferably selected to be the canted spring 900 of the type depicted in FIG. 9. The height of the conductive biasing member 165*c* in FIG. 11 is slightly greater than the depth of the recess 1104 of the conductive resilient positioning member 1102. Therefore, when the plating surface 154 of the substrate 148 is placed within the recess 1104 and the plating surface 154 of substrate initially contacts the contact point 907 of conductive biasing member 165*c*, the plating surface 154 will be spaced from both of the upper surfaces 1110 of the conductive resilient positioning member 1102 by space 1106. Additionally, the plating surface 154 will be separated from an upper surface 1112 of the seals 169*e*, 169*f* by space 1106. When sufficient force is applied to the substrate 148 to deform the combination of the conductive biasing member 165*c* and the conductive resilient positioning member 1102, the space 1106 will decrease until plating surface 154 contacts surfaces 1110 and 1112. A seal thereupon establishes itself between the plating surface 164 and the contact surfaces 1110, 1112.

When the canted spring is compressed along its height 902 in the embodiments shown in FIG. 11, the upper contact points 906 will be vertically displaced (e.g. to the left) relative to the contact points 907 due to the angle of the individual coils 904. This displacement causes sliding motion between contact points 907 and plating surface 154 of substrate 148, as well as sliding contact between contact points 906 and recess 1104. Such sliding contacts may improve electrical conduction between the engaging members due to scraping off oxidation that might form on the respective elements.

Both the conductive resilient positioning member 1102 and the conductive biasing member 165*c* compress as a result of force applied from the substrate 148 upon the conductive biasing member 165*c*. The relative compression of the conductive resilient positioning member 1102 and the conductive biasing member 165*c* can thus be controlled by regulating the relative spring constants of these two members. The spring constant of the conductive resilient positioning member 1102 is effected by, for example, by selecting a height shown by arrow 1120 of the conductive resilient positioning member 1102 below the conductive biasing member 165*c*. The adhesive member 168*a* shown in FIG. 11 is similar in structure and operation to the adhesive layer 168 shown in, and described relative to, the embodiments shown in FIGS. 6 and 7.

The selection of the material for the conductive biasing members 165 (FIG. 3), 165*a* and 165*b* (FIG. 7), and 165*c* (FIG. 11), as well as the conductive resilient positioning member 1102 of FIG. 11, is important for determining the operation of the present invention. Low resistivity, and conversely high conductivity, of the conductive biasing members 165 is directly related to good plating. To ensure low resistivity, the conductive biasing members 165 are preferably made of, for example, copper (Cu), copper alloys (Cu:Be), platinum (Pt), tantalum (Ta), titanium (Ti), gold (Au), silver (Ag), stainless steel or other conducting materials. Low resistivity and low contact resistance may also be achieved by coating the conductive biasing member with a conducting material. Thus, the conductive biasing member may, for example, be made of copper (resistivity for copper is approximately $2\times10^{-8}$ Ω·m) and be coated with platinum (resistivity for platinum is approximately $10.6\times10^{-8}$ Ω·m). Coatings such as tantalum nitride. (TaN), titanium nitride (TiN), rhodium (Rh), Au, Cu, or Ag on conductive base materials such as stainless steel, molybdenum (Mo), Cu, and Ti are also possible. Either, or both of, contact plate 180 or contact probe 179 may be coated with a conducting material. Additionally, because plating repeatability may be adversely affected by oxidation acting as an insulator, the contact probe 179 preferably is comprised of a material resistant to oxidation such as Pt, Ag, or Au.

Operation

Figure 6:
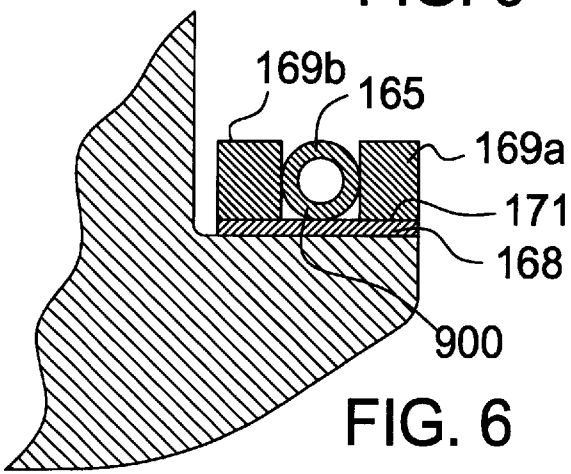
FIG. 6 is a further expanded view of the FIG. 5 cathode contact ring of FIG. 5 showing a conductive biasing member/seal portion of one embodiment of the present invention.

Now that the structure of multiple embodiments of conductive biasing members 165, 165*a*, 165*b*, and 165*c*, associated with a fountain plater 100 shown in FIG. 8 have been described, the following details one embodiment of the general operation of such a fountain plater comprising such conductive biasing members. In general, the characteristics accomplished by each of the FIGS. 3, 7 and 11 embodiments of the present invention relative to elements disposed adjacent to the substrate sealing surface 168 include: 1) biasing by the conductive biasing member 165 against substrate 148 to maintain a solid electrical contact between the conductive biasing member and the substrate 148, and 2) forming and maintaining a seal between the substrate seating surface 168 and the substrate 148. In FIG. 6, two seals 169*a* and 169*b* are positioned on opposite sides, i.e. radially inwardly and radially outwardly, of the conductive biasing member 165, all of which are positioned adjacent to substrate seating surface 168. Though FIG. 6 depicts one embodiment having two seals 169*a* and 169*b*, FIG. 7 depicts another embodiment having two seals 169*c* and 169*d*, and FIG. 11 shows yet another embodiment having two seals 169*e*, 169*f*, one or a larger number of seals may be used to seal the conductive biasing member while remaining within the scope of the present invention. Alternatively no seals can be used and the conductive biasing member 165 can be configured to perform a sealing function. For example, the conductive biasing member 165 may be embedded in a conductive sealing member such that the unified conductive biasing member and seal structure performs the sealing, biasing, and conducting functions.

The seals 169*a* and 169*b*, in a preferred embodiment, may be formed from an elastomeric material. In FIG. 7, when substrate 148 contacts the conductive biasing member 165 in the relaxed state of the latter, there will be a small vertical space 181 between substrate 148 and each of the seals 169*c*, 169*d*. However, when the conductive biasing member 165 is compressed slightly by the substrate, the substrate encounters upper surface of seals 169*c*, 169*d*. Applying an even greater force to the substrate 148 towards the substrate seating surface 168 than is necessary for the substrate 148 to contact seals 169*c*, 169*d* results in further compression of both the conductive biasing member 165 and each of the seals 169*c*, 169*d*. When seal 169*c* contacts substrate 148 in FIGS. 7 and 8, an enclosure is partially defined that includes electrolyte container 142 that limits the passage of material contained in the electrolyte container from encountering, and interacting with, the conductive biasing member 165. This sealing of conductive biasing member 165, and the associated reduction of exposure to impurities, increases the longevity of the conductive biasing member 165, and improves its electrical characteristics. Adhesive layer 171, depicted in FIG. 6, secures the seals 169*a*, 169*b*, and the conductive biasing member 165 relative to the substrate seating surface 168. In certain embodiments, adhesive layer 171 may be applied to only certain discrete, spaced, locations. Certain embodiments do not require an adhesive layer 171 to be located between conductive biasing member 165 and substrate seating surface 168 since seals 169*a* and 169*b* can laterally retain the conductive biasing member.

The adhesive layer is only necessary in those instances where the seals 169*a*, 169*b* and/or the conductive biasing member would shift into an ineffective or undesirable position if the adhesive layer 171 did not effectively secure those elements in position. The adhesive layer must be selected to be sufficiently robust to resist changes caused by liquid introduction to enable seals 169*a*, 169*b* and conductive biasing member 165 to be retained in position when repeatedly cycled. If adhesive layer 171 is non-permanent, but sufficient for operational integrity, then seals 169*a*, 169*b* in FIG. 6 and 169*c* and 169*d* in FIG. 7, and conductive biasing member 165 in FIG. 6 and 165*a* and 165*b* in FIG. 7, may be replaced. This replacement preferably occurs when one or more of the parts become worn, coated with deposits, defective or for some other reason. This replacement feature permits replacing only those parts that need replacement compared with replacing the entire, relatively expensive, contact ring 152.

During processing, seals 169*a* and 169*b* of FIG. 6, or 169*c* and 169*d* of FIG. 7, maintain contact with a peripheral portion of the substrate plating surface and are compressed to provide a seal between the remaining cathode contact ring 152 and the substrate. Seals 169*a* and 169*b* (FIG. 3) or 169*c* and 169*d* (FIG. 7) or 169*e* and 169*f* (FIG. 11) prevent electrolyte contained in electrolyte container 142 in FIG. 8 from contacting the edge and backside 175 of the substrate 148. As noted above, maintaining a clean contact surface (i.e., from deposits) is necessary to achieving high plating repeatability and increasing longevity of the contact ring 152. Prior art contact ring designs do not provide consistent plating results because contact surface topography varies over time, partially due to deposits. The contact ring of the present invention eliminates, or least minimizes, deposits accumulating on the contact pins 56 of FIG. 1, thus changing their electromagnetic field characteristics. Thus the present invention results in highly repeatable, consistent, and uniform plating across the substrate plating surface 54.

During processing, the substrate 148 is secured to the substrate supporting surface 146 of the lid 144 by suction produced in a plurality of vacuum passages 160 formed in the surface 146 by a vacuum pump (not shown). The contact ring 152 is connected to power supply 149 to provide power to the substrate 148. Contact ring 152 includes flange 162, sloping shoulder 164 conforming to the annular weir 143, an inner substrate seating surface 168 which defines the diameter of the substrate plating surface 154 and conductive biasing member 165, as described above. Shoulder portion 164 is configured such that substrate seating surface 168 is located below the flange 162. This geometry allows the substrate plating surface 154 to contact the electrolyte before the electrolyte solution flows into the egress gap 158, as discussed above. The contact ring design may vary from the FIG. 10 configuration without departing from the scope of the present invention.

Electrical Circuitry

Figure 10:
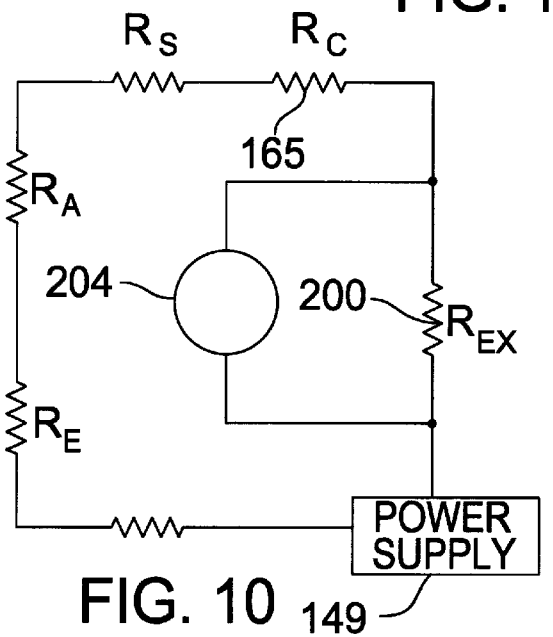
FIG. 10 is an electrical schematic diagram of power supply that supplies electricity to the conductive biasing member of one embodiment of the present invention.

FIG. 10 is a schematic diagram representing one embodiment of the electrical circuit that applies electricity from the power supply 149 to multiple conductive biasing members 165; if more than one is present, an external resistor 200 is connected in series with each of the conductive biasing members 165. The FIG. 10 schematic diagram assumes that the resistance of each segment of the conductive biasing member 165 is approximately equal. If this is not the case, the calculations relative to the relative resistances, outlined below, have to be modified accordingly. Preferably, the resistance value of the external resistor 200 (represented as $R_{EX}$) is much greater than the resistance of any other component of the circuit. As shown in FIG. 8, the electrical circuit through each conductive biasing member 165 is represented by the resistance of each of the components connected in series with the power supply 149. $R_E$ represents the resistance of the electrolyte, which is typically dependent on the distance between the anode and the cathode contact ring and the composition of the electrolyte chemistry. $R_A$ represents the resistance of the electrolyte adjacent the substrate plating surface 154. $R_S$ represents the resistance of the substrate plating surface 154, and $R_C$ represents the resistance of the cathode conductive biasing members 165 plus the constriction resistance resulting at the interface between the contact probe 179 and the conductive biasing member 165. Generally, the resistance value of the external resistor ($R_{EX}$) is at least as much as R (where R equals the sum of $R_E$, $R_A$, $R_S$ and $R_C$). Preferably, the resistance value of the external resistor ($R_{EX}$) is much greater than R such that R is negligible and the resistance of each series circuit approximates $R_{EXT}$.

Power supply 149 is connected to each conductive biasing member 165 via contact probe 179 (if more than one exists), resulting in parallel circuits through the contact probe 179. However, as the contact probe 179-to-substrate 148 interface resistance varies, so will the current flow for an electric power supply 149 having a particular voltage. More plating occurs at lower resistance sites. However, by placing an external resistor 189 in series with each conductive biasing member 165, the amount of electrical current passed through each conductive biasing member 165 becomes controlled primarily by the value of the external resistor. As a result, the variations in the electrical properties between each of the contact probes 179 do not affect the current distribution on the substrate, and a uniform current density results across the plating surface which contributes to a uniform plating thickness.

In addition to being a function of the contact material, the total resistance of each circuit is dependent on the geometry, or shape, of the contact probe 179 shown in FIG. 3, the shape of the contact plate 180, and the force supplied by the substrate 148 upon contact ring 152. These factors define a constriction resistance, $R_{CR}$, at the interface of the substrate 148 and the conductive biasing member 165 due to asperities between the two surfaces.

Generally, as the applied force between the two surfaces is increased the apparent contact area between the two surfaces is also increased. The apparent area is, in turn, inversely related to $R_{CR}$. Therefor, to minimize overall resistance it is preferable to maximize force between substrate 148 and the substrate seating surface 168. The maximum force applied in operation is practically limited by the yield strength of a substrate and spring member that may be damaged under excessive force and resulting pressure. However, because pressure is related to both force and area, the maximum sustainable force is also dependent on the geometry of the contact probe 179. A person skilled in the art will readily recognize other shapes which may be used to advantage. A more complete discussion of the relation between contact geometry, force, and resistance is given in Integrated Device and Connection Technology, D. Baker et al., Prentice Hall, Chapter 8, pp. 434–449 (incorporated herein by reference).

Although the contact ring 152 of the present invention is designed to resist deposit buildup on the conductive biasing member, over multiple substrate plating cycles the substrate-pad interface resistance may increase, eventually reaching an unacceptable value. An electronic sensor/alarm 204 can be connected across the external resistor 200 to monitor the voltage/current across the external resistor as shown in FIG. 10. If the voltage/current across the external resistor 200 falls outside of a preset operating range indicative of a high conductive biasing member 165 resistance, the sensor/alarm 204 triggers corrective measures such as shutting down the plating process until the problems are corrected by an operator. Alternatively, a separate power supply can be connected to each conducting biasing member 165 and can be separately controlled and monitored to provide a uniform current distribution across the substrate. A control system, typically comprising a processing unit, a memory, and any combination of devices that are known in the industry, may be used to supply and modulate the current flow. As the physiochemical, and hence electrical, properties of the conductive biasing members 165 change over time, the VSS processes and analyzes data feedback. The data is compared to pre-established setpoints and the VSS then makes appropriate current and voltage alterations to ensure uniform deposition.

During operation, the contact ring 152 applies a negative bias to the portions of the plating surface 154 of the substrate 148 that are covered with a seed layer. The seed layer therefore becomes negatively charged and acts as a cathode. As the electrolyte solution contained in electrolyte containers 142 contacts the substrate plating surface 154, the ions in the electrolytic solution are attracted to the substrate plating surface 154. The ions that impinge on the substrate plating surface 154 react therewith to form the desired film. In addition to the consumable anode 156 and the cathode contact ring 152 described above, an auxiliary electrode 167 may be used to control the shape of the electrical field over the substrate plating surface 154. An auxiliary electrode 167 is shown here disposed through the container body 142 adjacent to an exhaust channel 169. By positioning the auxiliary electrode 167 is adjacent to the exhaust channel 169, the electrode 167 able to maintain contact with the electrolyte during processing and affect the electrical field.

While foregoing is directed to the preferred embodiment of the present invention, other and further embodiments of the invention may be devised without departing from the basic scope thereof, and the scope thereof is determined by the claims.

What is claimed is:

1. A contact ring for use in an apparatus for electroplating a metal onto a substrate having an electrically conductive portion, the contact ring comprising:

an annular insulative body defining a central opening;

a plurality of conductive biasing members formed into the annular insulative body, each of the plurality of conductive biasing members being electrically isolated from each other via the annular insulative body and configured to exert a biasing force upon the substrate; and a power supply in parallel electrical communication with each of the plurality conductive biasing members, the power supply being configured to control the amount of electrical current supplied to each of the plurality of conductive biasing members through an a variable resistor is series electrical communication with each of the plurality of conducive biasing members.

2. The contact ring set forth in claim 1, wherein the conductive biasing member is made from a material selected from the group consisting of copper (Cu), platinum (Pt), tantalum (Ta), tantalum nitride (TaN), titanium nitride (TiN), titanium (Ti), gold (Au), silver (Ag), stainless steel, and any combination thereof.

3. The contact ring set forth in claim 1, wherein the annular insulative body is formed from an insulating material selected from the group consisting of polyvinylidene-fluoride (PVDF), perfluoroalkoxy resin (PFA), polytetrafluoroethylene (PTFE) fluoropolymer, ethylene-tetrafluoroethylene (ETFE) fluoropolymer, Alumina ($Al_2O_3$), ceramic, and any combination thereof.

4. The contact ring set forth in claim 1, wherein the conductive biasing member is deformed when the substrate is positioned adjacent the conductive biasing member.

5. The contact ring set forth in claim 4, wherein the biasing member moves laterally when deformed.

6. The contact ring set forth in claim 1, wherein the conductive biasing member comprises at least one spring.

7. The contact ring set forth in claim 6, wherein the spring comprises a canted spring.

8. The contact ring set forth in claim 1, further comprising a conductive resilient positioning member positioned adjacent the conductive biasing member.

9. The contact ring of claim 8 wherein the conductive resilient positioning member includes a recess for receiving the conductive biasing member.

10. The contact ring set forth in claim 1, wherein the conductive biasing member comprises a plurality of conductive biasing segments arranged around a periphery of the annular insulative body.

11. The contact ring set forth in claim 1, further comprising a seal member coupled to the annular insulative body and positioned between the central opening and the conductive biasing member.

12. The contact ring set forth in claim 11, wherein the seal member comprises a substantially rectangular block disposed adjacent to the conducting biasing member.

13. The contact ring set forth in claim 11, wherein the seal member and the conductive biasing member are removable as a unit from the contact ring.

14. The contact ring of claim 11 wherein the seal member comprises first and second annular seals disposed adjacent the conductive resilient positioning member.

15. An apparatus for electroplating a metal onto a substrate, comprising:

(a) an electroplating cell body;

(b) an anode disposed at a lower end of the body;

(c) a cathode contact ring at least partially disposed within the cell body, the cathode contact ring comprising:

(i) an annular insulative body defining a central opening;

(ii) a plurality of conductive biasing members formed into the annular insulative body and configured to exert a biasing force upon the substrate; and (iii) a seal member coupled to the annular insulative body and disposed between the central opening and the plurality of conductive biasing members; and (d) at least one power supply coupled to the plurality of conductive biasing members and being configured to regulate the current supplied to each individual conductive biasing member of the plurality of conductive biasing members via a variable resistor in series electrical communication with each of the plurality of conductive biasing members.

16. The apparatus of claim 15, further comprising a variable resistor connected between each individual conductive biasing member and the power supply.

17. The apparatus of claim 16, wherein each of the plurality of conductive biasing members comprise a conducting coating selected from the group consisting of copper (Cu), platinum (Pt), tantalum (Ta), titanium (Ti), gold (Au), silver (Ag), rhodium (Rh), Titanium Nitride (TiN), stainless steel, and any combination thereof.

18. The apparatus of claim 15, wherein the annular insulative body may be removably disposed within the electroplating cell body.

19. The apparatus of claim 15, wherein the annular insulative body is formed from an insulating material selected from the group consisting of polyvinylidenefluoride (PVDF), perfluoroalkoxy resin (PFA), polytetrafluoroethylene (PTFE) fluoropolymer, ethylene-tetrafluoroethylene (ETFE) fluoropolymer, Alumina ($Al_2O_3$), ceramic, and any combination thereof.

20. The apparatus set forth in claim 15, wherein the individual conductive biasing member is deformed when the substrate is positioned adjacent the conductive biasing member.

21. The apparatus set forth in claim 20, wherein the individual conductive biasing member moves laterally when deformed.

22. The apparatus set forth in claim 15, further comprising a conductive resilient positioning member positioned adjacent the individual conductive biasing member.

23. The apparatus of claim 22, wherein the conductive resilient positioning member includes a recess for receiving the conductive biasing member.

24. The apparatus set forth in claim 15, wherein the conductive biasing member comprises a plurality of conductive biasing segments disposed about the central opening of the annular insulative body.

25. The apparatus of claim 15, wherein the seal member comprises first and second annular seals disposed adjacent the conductive resilient positioning member.

26. A contact ring for use in an apparatus for electroplating a metal onto a substrate, the contact ring comprising:

an annular insulative body defining a central opening;

a plurality of conductive elements disposed through the insulative member, each of the plurality of conductive elements being in electrical communication with a power supply configured to individually control a current supplied thereto;

a conductive resilient positioning member disposed in electrical connection with the plurality of conductive elements; and a conductive biasing member comprising a canted spring disposed on the conductive resilient positioning member.

27. The contact ring of claim 26, wherein the conductive biasing member is made from a material selected from the group consisting of copper (Cu), platinum (Pt), tantalum (Ta), tantalum nitride (TaN), titanium nitride (TiN), titanium (Ti), gold (Au), silver (Ag), stainless steel, and any combination thereof.

28. The contact ring of claim 26, wherein the annular insulative body is formed from an insulating material selected from the group consisting of polyvinylidenefluoride (PVDF), perfluoroalkoxy resin (PFA), polytetrafluoroethylene (PTFE) fluoropolymer, ethylene-tetrafluoroethylene (ETFE) fluoropolymer, Alumina ($Al_2O_3$), ceramic, and any combination thereof.

29. The contact ring of claim 26, wherein the conductive biasing member comprises a plurality of conductive biasing segments disposed about the central opening of the annular insulative body.

30. The contact ring of claim 26 wherein the conductive resilient positioning member includes a recess for receiving the conductive biasing member.

31. The contact ring of claim 26, further comprising a seal member coupled to the annular insulative body and positioned between the central opening and the conductive biasing member.

32. The contact ring of claim 31 wherein the seal member comprises first and second annular seals disposed adjacent the conductive resilient positioning member.

33. An apparatus for electroplating a metal onto a substrate, comprising:

(a) an electroplating cell body;

(b) an anode disposed at a lower end of the body;

(c) a cathode contact ring disposed at an upper end of the cell body, the cathode contact ring comprising:

(i) an annular insulative body defining a central opening;

(ii) a plurality of conductive elements disposed through the insulative member;

(iii) a conductive resilient positioning member disposed in electrical connection with the plurality of conductive elements;

(iv) a plurality of conductive biasing members comprising a canted spring disposed on the conductive resilient positioning member; and (v) a seal member coupled to the annular insulative body and disposed between the central opening and the conductive biasing member; and (d) at least one power supply coupled to the cathode contact ring and configured to individually regulate the current supplied to each of the plurality of conductive biasing members.

34. The apparatus of claim 33, wherein the conductive biasing member is made from a material selected from the group consisting of copper (Cu), platinum (Pt), tantalum (Ta), tantalum nitride (TaN), titanium nitride (TiN), titanium (Ti), gold (Au), silver (Ag), stainless steel, and any combination thereof.

35. The apparatus of claim 33, wherein the annular insulative body is formed from an insulating material selected from the group consisting of polyvinylidenefluoride (PVDF), perfluoroalkoxy resin (PFA), polytetrafluoroethylene (PTFE) fluoropolymer, ethylene-tetrafluoroethylene (ETFE) fluoropolymer, Alumina ($Al_2O_3$), ceramic, and any combination thereof.

36. The apparatus of claim 33, wherein the conductive biasing member comprises a plurality of conductive biasing segments disposed about the central opening of the annular insulative body.

37. The apparatus of claim 33 wherein the conductive resilient positioning member includes a recess for receiving the conductive biasing member.

38. The apparatus of claims 33, wherein the cathode contact ring further comprises a seal member coupled to the annular insulative body and positioned between the central opening and the conductive biasing member.

39. The apparatus of claim 38 wherein the seal member comprises first and second annular seals disposed adjacent the conductive resilient positioning member.

40. A contact ring for use in an apparatus for electroplating a metal onto a substrate, the contact ring comprising:

an annular insulative body defining a central opening;

a plurality of conductive means disposed through the insulative member, each of the plurality of conductive means being in electrical communication with a power supply configured to control the electrical current supplied to each of the individual plurality of conductive means;

a conductive resilient positioning means disposed in electrical connection with the plurality of conductive elements; and a conductive biasing means for exerting a biasing force upon the substrate.

41. The contact ring of claim 40, wherein the conductive biasing means comprises a material selected from the group consisting of copper (Cu), platinum (Pt), tantalum (Ta), tantalum nitride (TaN), titanium nitride (TiN), titanium (Ti), gold (Au), silver (Ag), stainless steel, and any combination thereof.

42. The contact ring of claim 40, wherein the annular insulative body is formed from an insulating material selected from the group consisting of polyvinylidenefluoride (PVDF), perfluoroalkoxy resin (PFA), polytetrafluoroethylene (PTFE) fluoropolymer, ethylene-tetrafluoroethylene (ETFE) fluoropolymer, Alumina ($Al_2O_3$), ceramic, and any combination thereof.

43. The contact ring of claim 40, wherein the conductive biasing means comprises a canted spring disposed on the conductive resilient position member.

44. The contact ring of claim 40, wherein the conductive biasing means comprises a plurality of conductive. biasing segments disposed about the central opening of the annular insulative body.

45. The contact ring of claim 40, wherein the conductive resilient positioning member includes a recess for receiving the conductive biasing means.

46. The contact ring of claim 40, further comprising sealing means for sealing the conductive biasing means from contact with electrolyte.

47. The contact ring of claim 46, wherein the sealing means comprises first and second annular seals disposed adjacent the conductive resilient positioning member.

* * * * *